US006677558B2

(12) United States Patent
Kang

(10) Patent No.: US 6,677,558 B2
(45) Date of Patent: Jan. 13, 2004

(54) KEY INPUT APPARATUS IN ELECTRONIC OVEN AND CONTROL METHOD THEREOF

(75) Inventor: Dae Byung Kang, Kyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 09/985,892

(22) Filed: Nov. 6, 2001

(65) Prior Publication Data

US 2002/0070210 A1 Jun. 13, 2002

(30) Foreign Application Priority Data

Dec. 11, 2000 (KR) ..... 2000/75330

(51) Int. Cl.[7] ..... H05B 1/02

(52) U.S. Cl. ..... 219/490; 219/489; 219/702; 219/715

(58) Field of Search ..... 219/489, 490, 219/492, 494, 680, 663, 702, 754, 703, 705, 714, 715, 721

(56) References Cited

U.S. PATENT DOCUMENTS 4,383,157 A * 5/1983 Nakata et al. ..... 219/494
5,519,194 A * 5/1996 Gong ..... 219/494
5,958,277 A * 9/1999 Lee ..... 219/702

* cited by examiner

*Primary Examiner*—Tu Ba Hoang
(74) *Attorney, Agent, or Firm*—Birch, Stewart, Kolasch & Birch, LLP

(57) ABSTRACT

Disclosed are a key input apparatus in an electronic oven and a control method thereof enabling to reduce a size of a circuit as well as provide a simple design of the key input control part. A key input apparatus in an electronic oven includes a signal level producing part receiving input signals having a uniform level and producing signals having various levels, and a control part receiving the signals having the various levels through one input port and carrying out operations corresponding the signals having the various levels.

19 Claims, 3 Drawing Sheets

KEY INPUT APPARATUS IN ELECTRONIC OVEN AND CONTROL METHOD THEREOF

BACKGROUND OF THE INVENTION

1. Field of the Invention

The present invention relates to a key input apparatus in an electronic oven and a control method thereof, and more particularly, to key input apparatus in electronic oven and control method thereof which are capable of manipulating an operation of the electronic oven using key input signals having various levels.

2. Background of the Related Art

Lately, convenience having various functions in cooking increases a demand for electronic(microwave) ovens. Thus, manufacturers of the electronic ovens make many efforts to adding various functions to the electronic ovens as well as reducing retail and product costs.

A plurality of keys manipulated by a user in various parts constructing the electronic wave make the product cost high. Namely, the keys should be provided for automatic cooking, manual cooking, thaw, warming and the like. For instance, the automatic cooking key further includes additional keys for pop-corn, boiled egg, steamed potato, pizza and the like.

FIG. 1 illustrates a diagram for a key input apparatus in an electronic oven according to a related art.

Referring to FIG. 1, a key input apparatus in an electronic oven includes a switch part 13 receiving key scan signals P01, P02, P03, and P04 having uniform levels and outputting switching signals corresponding to the key scan signals P01, P02, P03, and P04 having the uniform levels by being manipulated by a user, a signal level setting part 12 receiving the switching signals and producing key input signals PIa, PIb, PIc, PId, and PIe having previously-set levels, and a key input control part 11 detecting the key input signals PIa, PIb, PIc, PId, and PIe inputted into digital signal ports and carrying out operations corresponding the detected key input signals, and outputting the key scan signals P01, P02, P03, and P04 to the switch part 13.

The switch part 13 includes input ports 1, 2, 3, and 4 as many as the number(ex. 4) of the key scan signals P01, P02, P03, and P04 to receive the key scan signals respectively, a plurality of key switches Bmn to switch the key scan signals and output ports a, b, c, d, and e to output a plurality of the switching signals. And, the key switches Bmn, for instance, 20 of them($\{1, 2, 3, 4\}\times\{a, b, c, d, e\}$), are arranged as a matrix form so as to switch to output the four key scan signals to the respective output ports a, b, c, d, and e.

The signal level setting part 12 includes resistors R1 to R5 to adjust the levels of the switching signals outputted from the switch part 13 and capacitors C1 to C5 to output stable signals.

Operation of the key input apparatus in the electronic oven according to the related art is explained as follows.

When the key input control part 11 outputs the key scan signals P01, P02, P03, and P04 having uniform levels of uniform cycles to the switch part 13, a user pushes one of the switches randomly so that the switch part 13 outputs one of the key scan signals P01, P02, P03, and P04 as a switching signal to the signal level setting part 12. For instance, when the user pushes the switch B11, the key scan signal P01 is outputted to the signal level setting part 12 through the output port a. The resistor R1 and capacitor C1 included in the signal level setting part 12 then adjusts the level of the switching signal to produce the key input signal PIa and then outputs the produced key input signal PIa to the digital signal input port.

Therefore, the key input control part 11 detecting the key input signal PIa inputted into the digital input port and carries out a cooking operation corresponding to the key input signal PIa.

Meanwhile, other switches having failed to be pushed by the user are at off-state, thereby producing no switching signals.

Unfortunately, the key input apparatus in the electronic oven according to the related art, as the functions of the electronic oven increase, fails to avoid increasing a size of the circuit for producing the key input signals proportionally.

Moreover, the key input apparatus according to the related art should be equipped with a plurality of input ports at the key input control part as well.

SUMMARY OF THE INVENTION

Accordingly, the present invention is directed to a key input apparatus in an electronic oven and control method thereof that substantially obviates one or more problems due to limitations and disadvantages of the related art.

An object of the present invention is to provide a key input apparatus in an electronic oven enabling to operate the electronic oven by receiving key input signals having various levels through one port.

Another object of the present invention is to provide a method of controlling a key input apparatus in an electronic oven enabling to operate the electronic oven by receiving key input signals having various levels through one port.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a key input apparatus in an electronic oven according to the present invention includes a signal level producing part receiving input signals having a uniform level and producing signals having various levels, and a control part receiving the signals having the various levels through one input port and carrying out operations corresponding the signals having the various levels.

In another aspect of the present invention, a method of controlling a key input apparatus in an electronic oven includes the steps of producing signals having various levels by receiving input signals having a uniform level, detecting levels of the signals having the various levels, and carrying out operations corresponding to the signals having the detected levels, respectively.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings.

Figure 1:
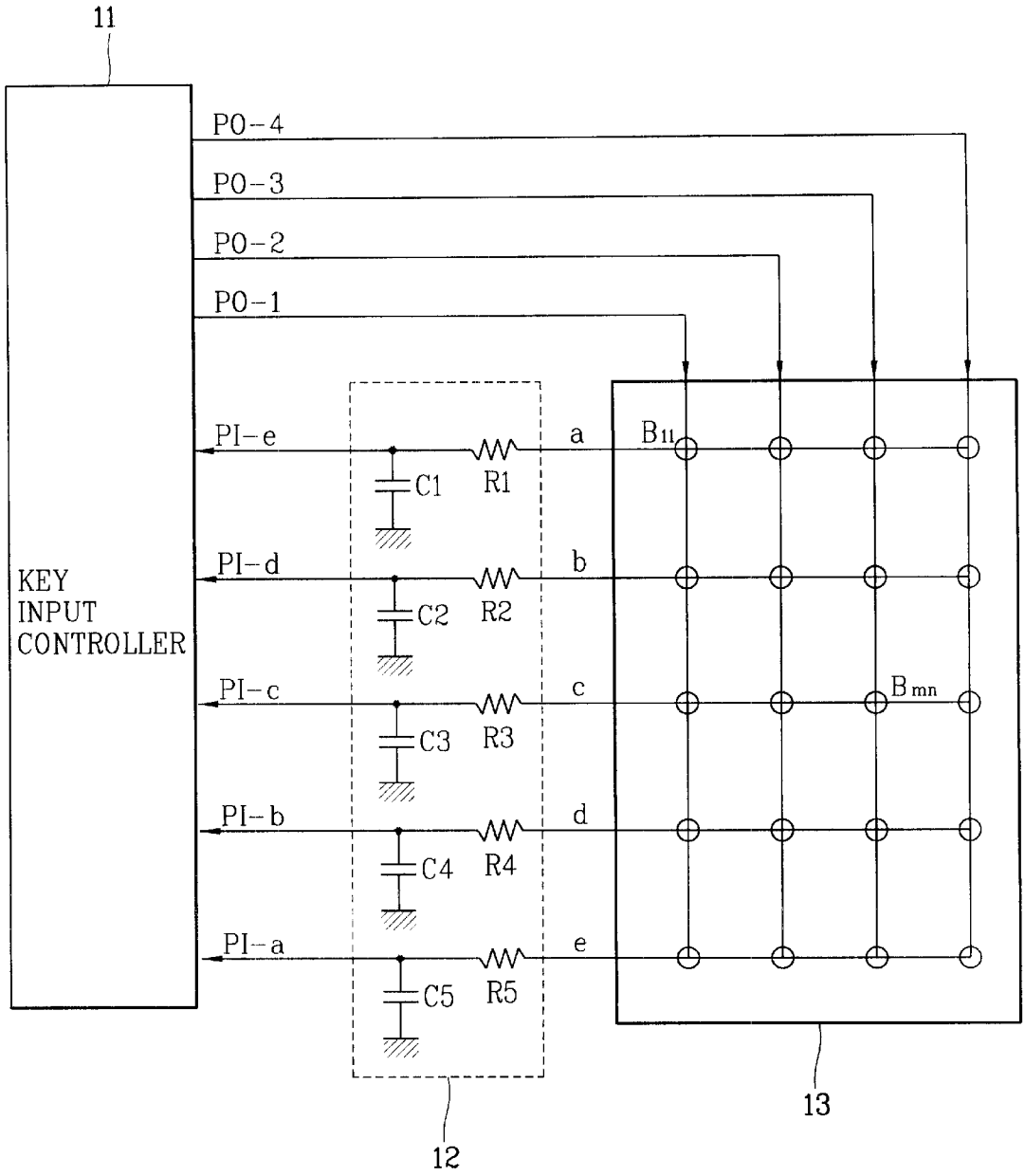
FIG. 1 CONVENTIONAL ART
FIG. 1 illustrates a diagram for a key input apparatus in an electronic oven according to a related art.
Figure 2:
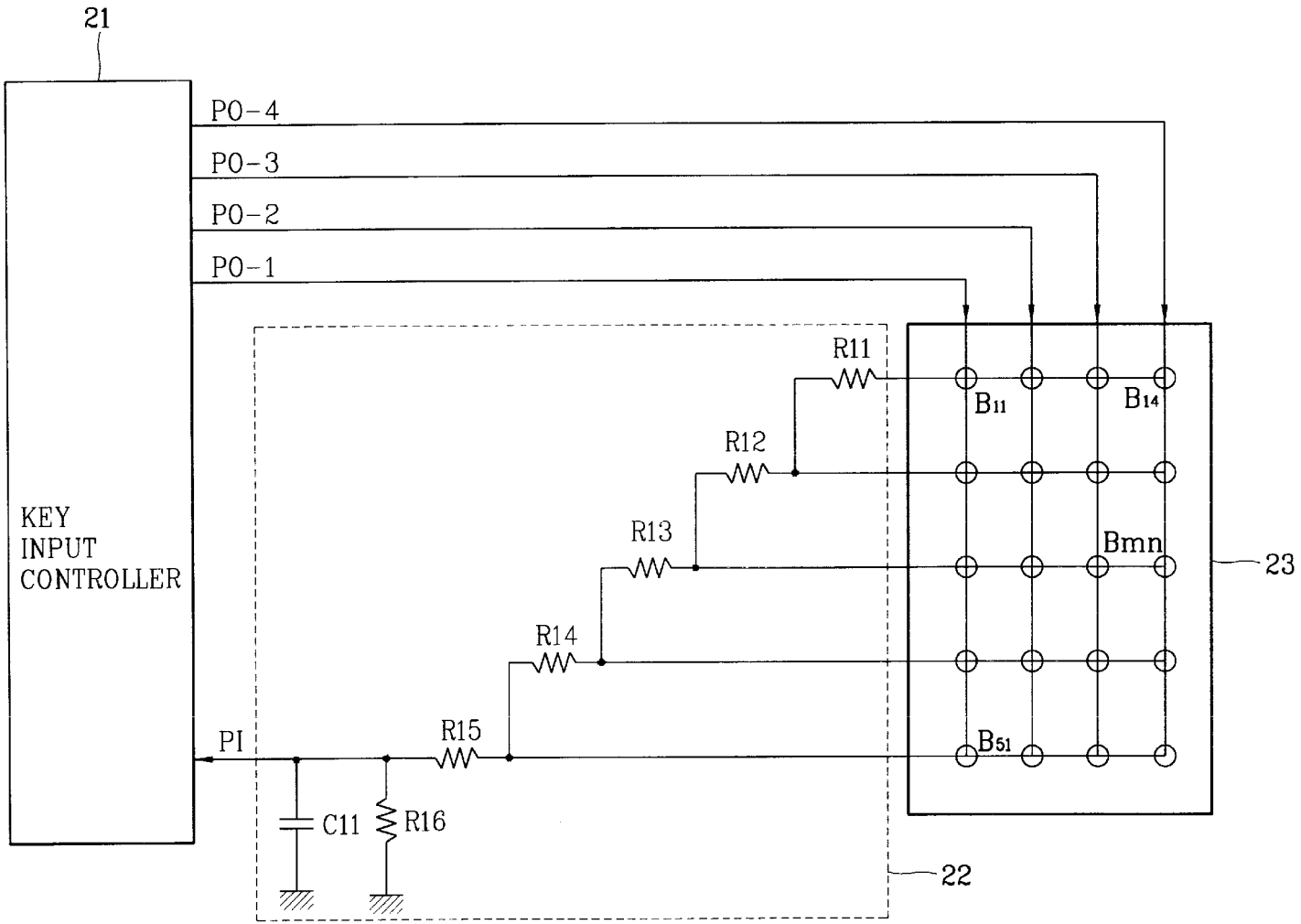
FIG. 2 illustrates a diagram for a key input apparatus in an electronic oven according to the present invention.

FIG. 2 illustrates a diagram for a key input apparatus in an electronic oven according to the present invention.

Referring to FIG. 2, a key input apparatus in an electronic oven according to the present invention includes a switch part 23 receiving key scan signals P01, P02, P03, and P04 having a uniform level and outputting switching signals corresponding to the key scan signals P01, P02, P03, and P04 having the uniform level by being manipulated by a user, a signal level producing part 22 receiving the switching signals, producing signals PIa, PIb, PIc, PId, and PIe having various levels, and outputting the produced signals PIa, PIb, PIc, PId, and PIe to one output port, and a key input control part 21 detecting the produced signals PIa, PIb, PIc, PId, and PIe having the various levels inputted into one analog signal input port, carrying out operations corresponding the detected signals, and outputting the key scan signals P01, P02, P03, and P04 to the switch part 23.

The switch part 23 includes input ports 1, 2, 3, and 4 as many as the number(ex. 4) of the key scan signals P01, P02, P03, and P04 to receive the key scan signals respectively, a plurality of key switches Bmn to switch the key scan signals and output ports a, b, c, d, and e to output a plurality of the switching signals. And, the key switches Bmn, for instance, 20 of them($\{1, 2, 3, 4\}\times\{a, b, c, d, e\}$), are arranged as a matrix form so as to switch to output the four key scan signals to the respective output ports a, b, c, d, and e.

The signal level producing part 22 includes a voltage divider constructed with a resistor R16 and other resistors R11, R12, R13, R14, and R15 arranged to correspond to the output port of the switch part and a capacitor C11 connected to the output port.

Figure 3A:
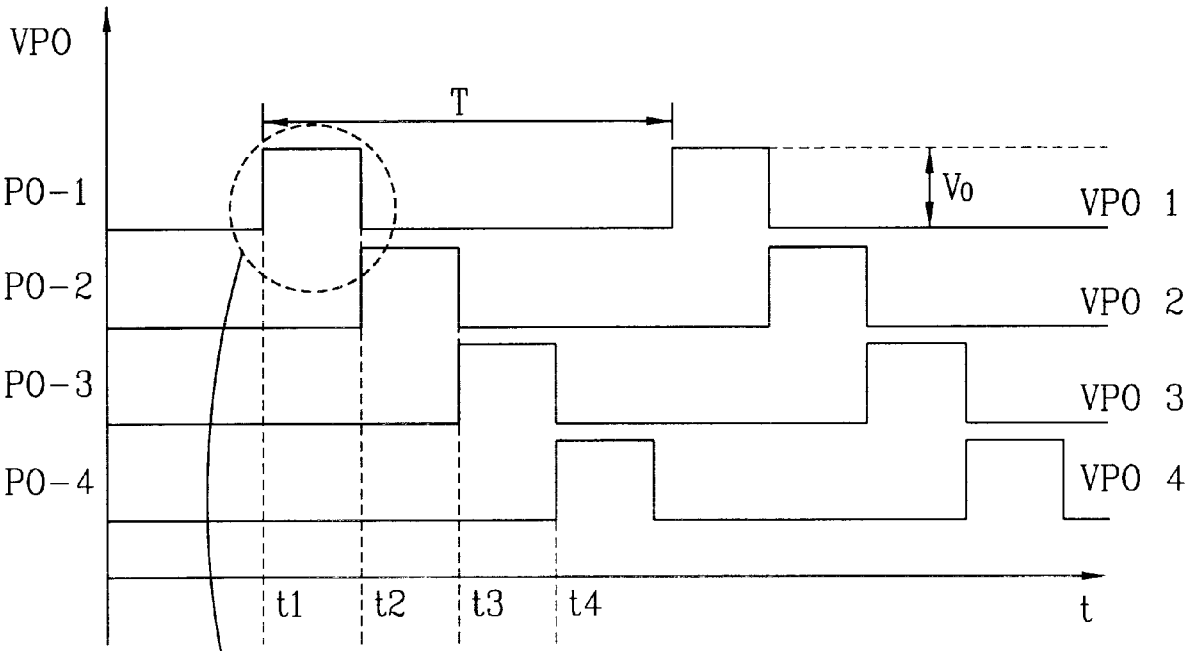
FIG. 3A illustrates waveforms of key scan signals of a key input apparatus in an electronic oven according to the present invention.
Figure 3B:
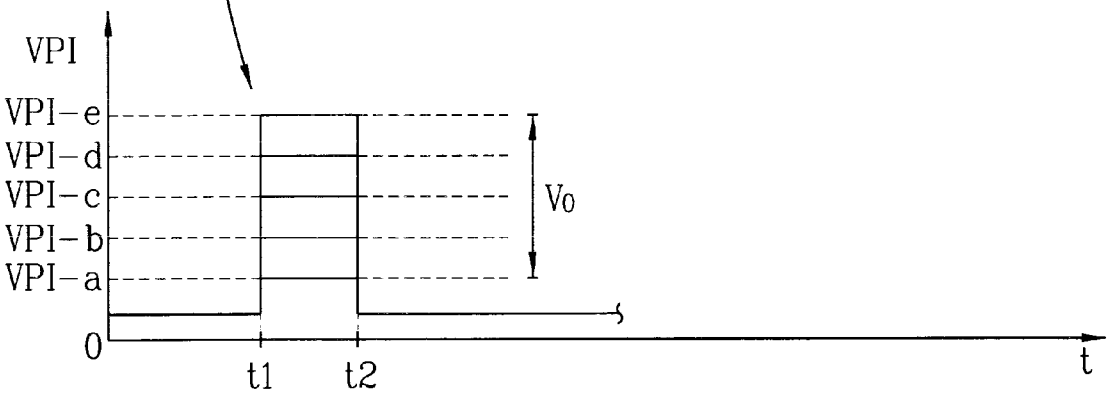
FIG. 3B illustrates waveforms of key input signals of a key input apparatus in an electronic oven according to the present invention.

FIG. 3A illustrates waveforms of key scan signals of a key input apparatus in an electronic oven according to the present invention, and FIG. 3B illustrates waveforms of key input signals of a key input apparatus in an electronic oven according to the present invention.

Operation of the key input apparatus in the electronic oven according to the present invention is explained by referring to FIG. 3A and FIG. 3B as follows.

The key input control part 21 outputs the key scan signals P01, P02, P03, and P04 having uniform width W, level $V_0$, and period T to the switch part 23 with intervals t1, t2, t3, and t4, respectively. In this case, when the user pushes the switch of the switch part 23 randomly, one of the key scan signals as a switching signal is outputted from the corresponding one of the output ports a, b, c, d, and e of the switch part 23. Explained in the following is a process of outputting the signal outputted from one of the output ports of the switch part 23 to the key input control part 21 by adjusting the outputted signal into various levels.

1) When the User Pushes the Switch B11

The key scan signal P01 shown in FIG. 3A is outputted as a switching signal through the output port a of the switch part 23. The outputted switching signal, as shown in FIG. 3B, is transformed into a key input signal PIa-1 having a relatively low high level [VPIa-1=(R16×VP01)/(R11+R12+R13+R14+R15+R16)] by the resistors R11, R12, R13, R14, and R15 and the other resistor R16. The key input signal PIa-1 is then outputted to the key input control part 21.

2) When the User Pushes the Switch B51

The key scan signal P01 shown in FIG. 3A is outputted as a switching signal through the output port e of the switch part 23. The outputted switching signal, as shown in FIG. 3B, is transformed into a key input signal PIe-1 having a relatively high level[VPIe-1=(R16×VP01)/(R15+R16)] by the resistors R15 and R16. The key input signal PIe-1 is then outputted to the key input control part 21.

In this case, the key input signal PIe-1 may be outputted from the signal level producing part 22 the moment the key input signal PIa-1 is generated. Yet, levels of the key input signals PIe-1 and PIa-1 are different from each other. Therefore, the key input control part 21 distinguishes the two signals by detecting the different levels and then carries out the corresponding cooking operation.

3) When the User Pushes the Switch B14

The key scan signal P04 shown in FIG. 3A is outputted as a switching signal through the output port a of the switch part 23. The outputted switching signal, as shown in FIG. 3B, is transformed into a key input signal PIa-4 having a relatively low level[VPIa-4=(R16×VP04)/(R11+R12+R13+R14+R15+R16)] by the resistors R11, R12, R13, R14, and R15 and the other resistor R16. The key input signal PIa-4 is then outputted to the key input control part 21.

In this case, the key input signal PIa-4 has the same level of the other key input signal PIa-1. Yet, the moments the key input signals PIe-1 and PIa-1 start are different from each other. Therefore, the key input control part 21 distinguishes the two signals by detecting the different initiating time points and then carries out the corresponding cooking operation.

When the rest switches are pushed, key input signals having various levels are produced through the above operations, respectively. The key input control part 21 detects the key input signals having various levels and then carries out the corresponding cooking operations, respectively.

Therefore, a key input apparatus in an electronic oven according to the present invention receives key scan signals P01, P02, P03, and P04 having a uniform level, produces signals PIa, PIb, PIc, PId, and PIe having various levels, and outputs the signals PIa, PIb, PIc, PId, and PIe to a key input control part. The key input control part then carries out each operation corresponding to the signal having a detected level using a method of detecting levels of the signals having the various levels.

Accordingly, a key input apparatus in an electronic oven and control method thereof according to the present invention enables to reduce a size of a circuit as well as provide a simple design of the key input control part by manipulating an operation of the electronic oven by receiving key input signals having various levels through a single port.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A key input apparatus in an electronic oven, comprising:

a signal level producing part receiving input signals having a uniform level and producing signals PIa, PIb, PIc, PId, and PIe having various levels; and a control part receiving the signals having the various levels through one input port and carrying out operations corresponding the signals having the various levels.

2. The apparatus of claim 1, wherein the input signals having the uniform level are the same signal patterns and distinguished from each other by uniform time intervals.

3. The apparatus of claim 1, wherein the input signals having the uniform level are the same signal patterns and outputted from the control part with a uniform time interval.

4. The apparatus of claim 1, wherein the various levels are attained by dividing the uniform level into different sizes.

5. The apparatus of claim 1, wherein the signal level producing part is a voltage divider producing the signals having the various levels by dividing the input signals having the uniform level.

6. The apparatus of claim 1, the signal level producing part comprising:

a switch part including switches arranged as a matrix form to switch the input signals having the uniform level into switching signals, the switch part outputting the switching signals, wherein the number of the switches corresponds to a number attained by multiplying the number of the input signals by the number of the various levels; and a signal level setting part adjusting levels of the received switching signals from the switch part and outputting the signals having the various levels.

7. The apparatus of claim 6, wherein the switching signals are equivalent to the input signals having the uniform level.

8. The apparatus of claim 6, wherein the signal level setting part is a voltage divider enabling to output different levels by adjusting levels of the switching signals.

9. The apparatus of claim 1, wherein the input port of the control part is an analog signal input port.

10. A method of controlling a key input apparatus in an electronic oven, comprising the steps of:

producing signals having various levels by receiving input signals having a uniform level;

receiving the signals having the various levels through a single input port of a control part;

detecting levels of the signals having the various levels; and carrying out operations corresponding to the signals having the detected levels, respectively.

11. A key input apparatus, comprising:

a signal level producing part receiving input signals having a uniform level and producing signals having various levels; and a control part receiving the signals having the various levels through one input port and carrying out operations corresponding to the signals having the various levels.

12. The apparatus of claim 11, wherein the input signals having the uniform level are the same signal patterns and are distinguished from each other by uniform time intervals.

13. The apparatus of claim 11, wherein the input signals having the uniform level have the same signal patterns and are outputted from the control part with a uniform time interval.

14. The apparatus of claim 11, wherein the various levels are attained by dividing the uniform level into different sizes.

15. The apparatus of claim 11, wherein the signal level producing part is a voltage divider producing the signals having the various levels by dividing the input signals having the uniform level.

16. The apparatus of claim 11, the signal level producing part comprising:

a switch part including switches arranged as a matrix form to switch the input signals having the uniform level into switching signals, the switch part outputting the switching signals, wherein the number of the switches corresponds to a number attained by multiplying the number of the input signals by the number of the various levels; and a signal level setting part adjusting levels of the received switching signals from the switch part and outputting the signals having the various levels.

17. The apparatus of claim 16, wherein the switching signals are equivalent to the input signals having the uniform level.

18. The apparatus of claim 16, wherein the signal level setting part is a voltage divider enabling output of different levels by adjusting levels of the switching signals.

19. The apparatus of claim 11, wherein the input port of the control part is an analog signal input port.

* * * * *